United States Patent [19]

Easton et al.

[11] 4,194,717

[45] Mar. 25, 1980

[54] WEDGE AND BOLT ASSEMBLY FOR PANEL UNITS

[76] Inventors: John T. Easton, 15073 Marl Dr.; Harry J. Harden, 15063 Marl Dr., both of Linden, Mich. 48451

[21] Appl. No.: 952,392

[22] Filed: Oct. 18, 1978

[51] Int. Cl.[2] ..... E04G 17/04

[52] U.S. Cl. ..... 249/192; 249/45; 249/46; 249/47; 249/196; 249/216

[58] Field of Search ..... 249/191, 196, 192, 213, 249/216, 45, 46, 47

[56] References Cited

U.S. PATENT DOCUMENTS

| | | | |
|---|---|---|---|
| 3,160,940 | 12/1964 | Jennings | 249/191 |
| 3,204,918 | 9/1965 | Bonin et al. | 249/196 |
| 3,447,771 | 6/1969 | Trimmer | 249/192 |
| 3,862,737 | 1/1975 | Fuston | 249/196 |
| 3,877,674 | 4/1975 | Cerutti | 249/196 |

*Primary Examiner*—Donald J. Arnold
*Attorney, Agent, or Firm*—Basile and Weintraub

[57] ABSTRACT

A concrete wall form structure of the type having a pair of aligned contiguous pre-fabricated panel units disposed in an edged-edged, upstanding relationship. Each panel unit has one of its marginal frame members abutting an adjacent marginal frame member of the panel unit. The panel unit edges have a plurality of aligned apertures in each of the abutting frame members whereby at least two apertures of abutting frame members are aligned and receive an elongated bolt. One of the panel units slidably carries the bolt so that it is movable between a retracted rear position wherein the bolt is moved within the confines of that one panel unit and an advanced forward position wherein the forward end of the bolt is projected through both apertures of the adjacent frame members and within the confines of the other panel unit. The projecting forward end of the bolt is provided with an elongated slot which receives a tapered wedge that bindingly engages the adjacent frame member to lockingly secure the panel units to each other.

3 Claims, 3 Drawing Figures

WEDGE AND BOLT ASSEMBLY FOR PANEL UNITS

BACKGROUND OF THE INVENTION

1. Field of the Invention

The present invention relates to concrete wall forms of the panel unit type wherein the opposed and spaced apart sides of the form are each constructed from a group of rectangular panel units in an upstanding and edge-edge relationship with wet concrete being poured into the space existing between the wall forms, and, in particular, the present invention relates to a fastening device for securing adjacent panel units together.

2. Description of the Prior Art

There has long been upon the market a class of reusable pre-fabricated panel units including a variety of concrete form hardware associated with such panel units. The hardware is used to provide a simple means for connecting the panel units to one another.

Examples of such prior art apparatus are disclosed in U.S. Pat. Nos. 3,584,827; 3,975,882; 1,014,630; 3,010,175; 1,567,210; 1,629,899; 2,600,362; 2,613,424; 1,137,998; 3,067,479; 3,756,555; 3,204,918; 3,160,940.

Many of the aforementioned patents disclose prefrabricated panel units having marginal frame members which are positioned in an edge-edge relationship to build up a concrete wall form. Holes which are formed in the marginal frame members function to receive slotted shanks of t-bolts which extend therethrough. The t-bolts may be passed through the ends of tie-rods and are held in position by wedges which are driven through the slots of the shanks of the t-bolts. As the wedges are driven in place, they draw the abutting marginal frame members of adjacent panel units together due to the extremely tensional force in the t-bolts. The t-bolts and wedges frequently constitute a simple means for effecting panel interconnection. Furthermore, these bolts are readily removable for concrete wall form dismantling operations as it is only necessary to knock out the wedges and slide the t-bolts from their holes to release the panel units. In the erection of such concrete wall form panel units, a large quantity of hardware is necessary to attach the adjacent panel units together and it is customary for the workmen performing the erection and operation upon the scaffolding to carry with them large buckets of the hardware which is utilized to join the adjacent panel members. During such operations, the loss of hardware is appreciable especially in inclement weather as it is difficult to find bolts and/or wedges that may fall from scaffolding. Costs of labor and materials, therefore, have increased accordingly. The present invention is designed to overcome the aforementioned limitations that are attendant with the construction and installation of the conventional bolted and wedge assemblies used in connection with the fastening of the adjacent concrete wall form panels.

3. Prior Art Statement

To the knowledge of the applicant and the applicant's attorney, the aforementioned United States Patents constitute the closest prior art of which applicant and applicant's attorney are aware.

SUMMARY OF THE INVENTION

The present invention which is described subsequently in greater detail comprises a bolt and wedge assembly of the type having a bolt passing through abutting frame members of prefabricated concrete form panel units for purposes of securing adjacent panel units to each other and wherein the adjacent panel unit have peripheral frame edges with aligned apertures through which the bolt extends. Each bolt and wedge assembly includes a bolt having a slotted projecting end and an intermediate abutment land. Suitable support means are carried within the confines of one of the panel units for mounting the bolt such that it is movable between a first retracted position solely within the confines of the panel unit to a second extended position wherein the bolt projecting end extends through the aligned apertures of the frame edges into the confines of the adjacent unit. The projecting end of the bolt has a slotted portion which receives a wedge member that functions to draw the adjacent panel units together due to the tensional force exerted on the bolt between the wedge member and the intermediate land. The bolt is provided with a unique groove, positional in such a manner that when the bolt is withdrawn to the retracted position, the wedge member may be inserted in the groove to ensure that the bolt will stay at a retracted position thereby ensuring both the integrity of the system as well as to provide a simple way of accounting for and storing the wedge members.

It is, therefore, an object of the present invention to provide a pre-fabricated concrete wall form panel unit having a new and improved panel connecting hardware in the form of a permanently attached bolt and wedge assembly.

It is, also, an object of the present invention to provide a pre-fabricated concrete wall form panel unit wherein the hardware which is permanently associated therewith does not differ appreciably in character and function from conventional bolt and wedge assemblies, but overcomes the aforementioned difficulties of the prior art hardware.

It is still a further object of the present invention to provide a pre-fabricated concrete wall form panel unit having permanently mounted panel connecting hardware of the type described herein, wherein the bolts associated with the unit are movable between a retracted inoperative position and an extended operative position wherein the bolt, at all times, is in either position and in proper alignment for accurate registry with adjacent holes of abutting panels, thus, eliminating the necessity for the operator to resort to bolt aligning operations.

It is a further object of the present invention to provide a pre-fabricated concrete wall form panel of the type described and having a bolt and wedge assembly wherein the wedge unit has functional use in both the retracted and extended positions of the bolt thereby minimizing the possibility of loss of hardware components.

Other objects, advantages and applications of the present invention become apparent to those skilled in the art of bolt and wedge assemblies for pre-fabricated concrete wall form panel units when the accompanying description of one example of the best mode contemplated for practicing the present invention is read in conjunction with the accompanying drawing.

BRIEF DESCRIPTION OF THE DRAWING

The description herein makes reference to the accompanying drawing wherein like reference numerals refer to like parts throughout the several views in which.

DESCRIPTION OF THE PREFERRED EMBODIMENT

Figure 1:
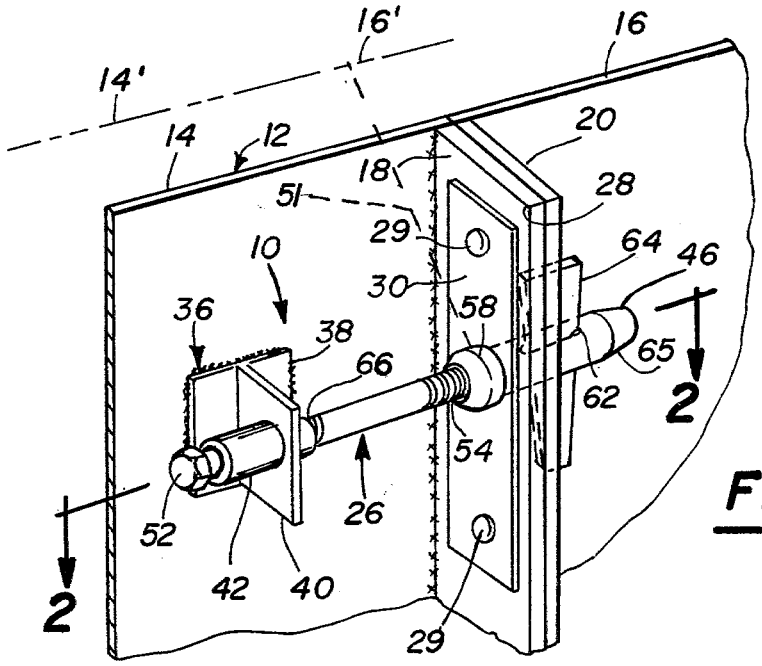
FIG. 1 is a fragmentary perspective view of one side of a concrete wall form installation showing a number of panel units constructed according to one example of the present invention and operatively installed therein in an edge-edge relationship.

Referring now to the drawing, and, in particular, to FIG. 1, wherein it is illustrated one example of the present invention in the form of a bolt and wedge assembly 10 incorporated on one side of a composite concrete wall form 12. The wall form 12 is made up of a series of rectangular panel units 14 and 16 (only two of which are shown) and arranged in an edge to edge relationship. Each of the panels 14 and 16, respectively, has a marginal reinforcing frame 18 and 20.

In erecting concrete wall form 12, the two panel units 14 and 16 are brought together with adjacent vertical marginal frames 18 and 20, respectively, abutting each other such that apertures 22 and 24, respectively, formed in the frames 18 and 20 are brought into axial alignment to receive the projecting end of a bolt 26, all of which will be described in greater detail hereinafter. It should be noted that the inside surfaces 28 of the frames 18, 20 are provided with bushing plates 30, 31 which are secured to the inside surfaces 28 by a pair of rivets 29. Each bushing plate 30, 31 is provided with an aperture (unnumbered), which is axially aligned with the apertures 22, 24 of the frame members 18 and 20, respectively.

Figure 2:
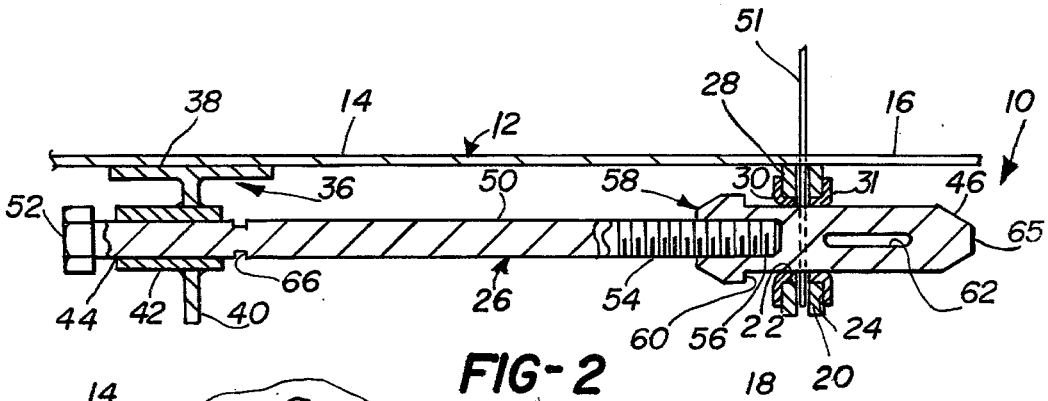
FIG. 2 is a fragmentary cross-sectional view of the bolt and wedge assembly illustrated in FIG. 1 of the drawing and taken along line 2—2 thereof.

As can best be seen in FIGS. 1 and 2 of the drawing, the panel unit 14 is provided with a structural support, such as T-flange 36 having a base 38 welded to the inside wall of the panel unit 14 while its leg 40 extends outwardly to mount a cylindrical guide 42. Other structural supports such as a brace extending from one unit to the next can be used herein.

Referring, again, to the drawing, the cylindrical guide 42 has an internal bore 44 (FIG. 2) which is axially aligned with the frame bore 22. The cylindrical guide bore 44 is adpated to slidably mount and support the bolt 26 for axial movement between a retracted rear position wherein the bolt 26 is moved completely within the confines of the one panel unit 14 such that the projecting end 46 of the bolt 26 is withdrawn from the frame bore 24 and an advanced forward position (FIG. 1), wherein the forward projecting end 46 of the bolt 26 is projecting through the bushing plates 30, 31 and through both holes 22, 24 and extends into the confines of the other panel member 16 for a purpose which will be described hereinafter.

As can best be seen in FIG. 2 of the drawing, the bolt 26 comprises an elongated bolt member 50 which has any conventional bolt head 52 formed at its left most end while it may be threaded, such as at 54, on the right end thereof. The projecting end 46 of the bolt assembly 26 is in the form of a solid lug that has an internally threaded end 56 that receives the threaded end 54 of the bolt member 50 to secure the two members to one another. An enlarged intermediate land 58 is formed on the threaded bore end of the lug 46 and defines a shoulder 60 which abuts the bushing plate 30 when the bolt and wedge assembly become operational in the manner to be described hereinafter. The lug end 46 of the bolt assembly 26 includes a longitudinal slot 62 which is adapted to snugly receive a tapered wedge member 64, as shown in FIG. 1 of the drawings. The outer most end of the projecting lug 46 is conically shaped, as shown at 65 for ease of aligning the bolt end 46 with the apertures 22, 24 and to ease the entry of the bolt therewithin. The purpose of the threaded engagement between the bolt member 50 and the lug 46 is to provide interchangeability of parts in a simple and economical manner and to facilitate the assembly of the bolt 50 through the aperture 44 in the bolt cylindrical guide 36. In FIG. 1, a parallel set of panel units 14' and 16' are schematically shown as being connected to the panel units 14 and 16 by means of form ties 51 in the conventional manner.

As can best be seen in FIG. 2, the left intermediate portion of the bolt member 50 is provided with an annular groove 66 which provides a function which will be described hereinafter. In the operation of the bolt and wedge assembly 10, erection of a given form assembly is such that when adjacent panel units 14 and 14' are brought into a side by side relation in the usual manner, the form ties 51 are hung between the adjacent panels 14 and 14'. The ties are hung on the associated lugs 46. The next set of panels 16 and 16' are then placed into an edge-to-edge contact with the panels 14 and 14', by sliding them onto the lug 46 of bolt assembly 26 which has been previously moved to the right to its advance forward position (FIG. 1), so that the lug 46 is projected through holes 22 and 24 whereby the slot 62 is exposed for wedge-receiving purposes. Thereafter, the wedge member 64 may be positioned to enter the slot 62 so that one edge of the wedge member 64 engages the inside surface of a bushing plate 31 and this action draws the bolt 26 forwardly to cause the shoulder 60 thereof to bear hard against the adjacent surface of the bushing plate 30 forcing the two panel units 14 and 16 close and tightly together.

Figure 3:
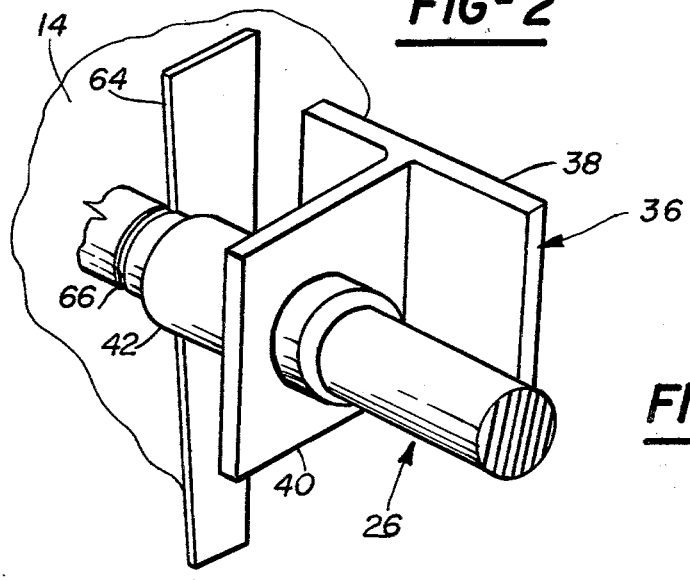
FIG. 3 is a fragmentary perspective view of FIG. 1 illustrating the bolt and wedge assembly in a retracted position.

After the wall has been formed and it is desired to remove the panel units 14 and 16, the wedge member 64 is removed from the slot 62 and the bolt member 50 is moved through the frame members 18 and 20 to its retracted rear position such that the projecting end 46 is completely withdrawn from the panel unit 16. At the same time, the groove 66 formed on the bolt member 50 is moved to the rear, left side (as viewed in FIG. 3) of the bolt support 36. As can best be seen in FIG. 3, the wedge member 64 is then received by the groove 66 such that the wedge member 64 is engaged between the bolt member 50 and the outside surface of the panel unit 14 to securely retain the bolt 50 in a retracted position so that it doesn't interfere with the assembly and disassembly of the panels 14 and 16. At the same time, this arrangement ensures that the wedge member 64 is available for future use when assembly of the panel units 14 and 16 is desired at a new location.

It should also be noted that the groove 66 define means for preventing retraction of the lug 46 when on adjacent panel is hung thereon thereby preventing loss of the associated form tie. This is achieved by inserting a wedge into the groove 66 when the bolt assembly 26 is on its advanced position.

It can thus be seen that the applicant has provided a new improved pre-fabricated concrete wall form panel unit having new and unique hardware which is utilized in the assembly of wall panel units.

While only one form of applicant's invention has been disclosed, it should be understood by those skilled in the art of such panel units and associated hardware that other forms of applicant's invention can be had, all coming within the spirit of the invention and the scope of the appended claims.

What is claimed is as follows:

1. A bolt and wedge assembly of the type having a bolt passing through abutting frame edges of a prefabricated panel so as to secure the panels to one another, the frame edges having aligned apertures, said bolt and wedge assembly comprising:

a bolt having a slotted projecting end and an intermediate abutment land; bushing plates carried by the inside surface of it at least one of said frame edges adjacent its aperture; means slidingly mounting said bolt within the confines of one of said panels for movement of said projecting end through said aligned apertures such that said abutment land engages the bushing plate while said slotted projected end of said bolt extends beyond the inside surface of said other frame edge within the confines of said other panel; and wedge means received in said slotted projecting end and wedgingly engaging the inside surface of said other frame edge to draw said panels toward one another, said bolt member having a groove formed in its peripheral edge, said wedge being received between said groove and the inside surface of said panel when said bolt assembly is in a retracted position so as to secure said bolt in said retracted position and to ensure that the wedge is available for the further use.

2. The bolt and wedge assembly defined in claim 1 wherein said means slidably mounting said bolt comprises a t-shaped flange having a base secured to the inside surface of said one panel within the confines thereof; said t-shaped flange having a leg extending outwardly and including a cylindrically shaped member mounted thereon having a bore which is axially aligned with said frame aligned apertures, said bolt having one end slidably received within said cylindrical bore and movable between a first retracted position wherein said bolt is totally within the confines of said one panel to a second extended position wherein said bolt is received by said aligned apertures and the slotted projecting end of said bolt is within the confines of said other panel to receive said wedge.

3. The bolt and wedge assembly defined in claim 1 wherein:

said wedge is received between said groove and the inside surface of said panel when said bolt assembly is in a projected position thereby preventing retraction of the lug when an adjacent panel is hung thereon.

* * * * *